United States Patent [19]

Arnold et al.

[11] 4,374,002

[45] Feb. 15, 1983

[54] METHOD FOR PRODUCING HIGHLY REFLECTIVE METAL SURFACES

[75] Inventors: Jones B. Arnold, Knoxville; Philip J. Steger; Ralph R. Wright, both of Oak Ridge, all of Tenn.

[73] Assignee: The United States of America as represented by the United States Department of Energy, Washington, D.C.

[21] Appl. No.: 354,571

[22] Filed: Mar. 4, 1982

[51] Int. Cl.[3] ..... C25D 1/06

[52] U.S. Cl. ..... 204/7; 204/38 B

[58] Field of Search ..... 204/7, 12, 38 B

[56] References Cited

U.S. PATENT DOCUMENTS

| | | | |
|---|---|---|---|
| 3,428,533 | 2/1969 | Pichel | 204/7 |
| 3,647,642 | 3/1972 | Olson | 204/12 X |
| 3,666,529 | 5/1972 | Wright et al. | 117/130 B |

FOREIGN PATENT DOCUMENTS

| | | | |
|---|---|---|---|
| 2063735 | 7/1971 | Fed. Rep. of Germany | 204/38 B |

OTHER PUBLICATIONS

Jostan et al., Electroforming of Extremely Smooth Metallic Substrates for Application in Microelectronics, Plating, pp. 399–404, 4/69.

A. K. Graham, Electroplating Engineering Handbook (2nd Edition), pp. 464–479, Reinhold Publishing Corp., New York.

Metal Finishing Guidebook and Directory, 1980, pp. 480–488, Metals and Plastics Publications, Inc., Hackensack, New Jersey.

*Primary Examiner*—G. L. Kaplan
*Assistant Examiner*—N. Nguyen
*Attorney, Agent, or Firm*—Fred O. Lewis; Stephen D. Hamel; Richard G. Besha

[57] ABSTRACT

The invention is a novel method for producing mirror surfaces which are extremely smooth and which have high optical reflectivity. The method includes electrolessly depositing an amorphous layer of nickel on an article and then diamond-machining the resulting nickel surface to increase its smoothness and reflectivity. The machined nickel surface then is passivated with respect to the formation of bonds with electrodeposited nickel. Nickel then is electrodeposited on the passivated surface to form a layer of electroplated nickel whose inside surface is a replica of the passivated surface. The electroplated nickel layer then is separated from the passivated surface. The mandrel then may be re-passivated and provided with a layer of electrodeposited nickel, which is then recovered from the mandrel providing a second replica. The mandrel can be so re-used to provide many such replicas. As compared with producing each mirror-finished article by plating and diamond-machining, the new method is faster and less expensive.

10 Claims, No Drawings

METHOD FOR PRODUCING HIGHLY REFLECTIVE METAL SURFACES

BACKGROUND OF THE INVENTION

This invention relates generally to methods for the production of mirror surfaces and more particularly to the production of replicas of a master mirror surface. The invention is a result of a contract with the United States Department of Energy.

This invention was developed in response to a need for a plurality of similar tubular articles having identical internal surfaces characterized by extreme smoothness, high reflectivity, and high contour accuracy. The surfaces were to be exposed to X-rays. Previously, highly smooth and reflective nickel surfaces had been produced by electrolessly plating nickel on a metal substrate and then diamond-machining the plating to a high degree of smoothness. That procedure was well suited to the production of surfaces on an occasional basis but was unduly expensive and time-consuming for the routine production of many such surfaces.

The term "electroless plating" is used herein to refer to the well-known process of forming metallic deposits on solid bodies through autocatalytic redox reactions conducted in water solutions. The electroless plating of nickel and certain other metals is described in the following publications: A. K. Graham, *Electroplating Engineering Handbook* (2nd Edition), pp. 464–479), Reinhold Publishing Corp., New York; *Metal Finishing Guidebook and Directory,* 1980, pp. 480–488, Metals and Plastics Publications, Inc., Hackensack, New Jersey; and U.S. Pat. No. 3,666,529, issued on May 30, 1972, to R. R. Wright, G. S. Petit, and C. C. Wright. Techniques for passivating electroless nickel surfaces are disclosed in *Metal Finishing Guidebook,* 1965, p. 192, Dow Metals Products Co., Midland, Michigan.

For convenience, the term "nickel" is used herein to refer to platings produced from nickel-containing baths by either electroplating or electroless plating. As is well known, the typical electroless nickel plating is an amorphous nickel-phosphorus alloy having a nickel content in the range of from about 85 to about 95 weight percent.

SUMMARY OF THE INVENTION

It is an object of this invention to provide a novel method for producing metallic surfaces characterized by high smoothness, high reflectivity, and high uniformity.

It is another object to provide a novel method for producing metallic mirror surfaces which are replicas of a master mirror surface.

It is another object to provide a novel method for producing a plurality of highly reflective nickel surfaces which are replicas of a master nickel surface.

Other objects and advantages of the invention will become evident hereinafter.

In one aspect, the invention comprises electrolessly depositing an amorphous layer of nickel on an article and then diamond-machining the resulting nickel surface to increase its smoothness, optical reflectivity, and accuracy. The machined nickel surface then is passivated with respect to the formation of bonds with electrodeposited nickel. Nickel is electrodeposited on the passivated surface to form a layer of electroplated nickel whose inner surface is a replica of the passivated surface. The electroplated nickel layer then is separated intact from the passivated surface.

DETAILED DESCRIPTION OF THE INVENTION

The invention is especially applicable to the production of a plurality of identical highly reflective surfaces of various compositions and configurations. For brevity, it will be illustrated as applied to the production of similar tubular articles having substantially identical, highly reflective inner surfaces composed of nickel.

In accordance with the invention, a suitable article is provided for use in the production of the desired replicate surfaces. The article may, for example, be in the form of a metallic support rod terminating in an axially extending cylindrical tip, or mandrel. The exterior of the mandrel is of a material (e.g., aluminum) which is compatible with the formation thereon of an adherent electroless nickel plating. The end face of the mandrel is masked off and the wall of the mandrel is provided with a coating (e.g., a continuous ten-mil layer) of electrolessly deposited nickel. The coating may be formed by any electroless nickel-plating technique applicable to aluminum, such as the conditioning-and-plating technique described in above-referenced Pat. No. 3,666,529. The plated mandrel then is diamond-machined in conventional fashion to provide a very smooth, highly reflective, highly accurate electroless-nickel surface. The thickness of the resulting mirror is not highly critical and may, for example, be three mils.

In accordance with the invention, a removable replica is formed on the mirror surface of the mandrel as follows. The mandrel is degreased in any suitable fashion, as by contacting with acetone and then with ethyl alcohol. The degreased mandrel is made wettable by any suitable treatment. (For example, the mandrel may be treated with a 20 wt.% aqueous solution of sodium lauryl sulfate or with Anti-Pit No. 7, manufactured by M and T Chemicals, Inc., Rahway, New Jersey.) Foaming should be kept to a minimum. Preferably, the treated surface is wiped with cotton or lint-free cloth. The mandrel then is promptly rinsed with distilled water and, while wet, passivated with respect to the formation of bonds with electroplated nickel. Any suitable passivation technique may be used. The preferred passivation treatment comprises exposing the mandrel to a 10 wt.% solution of potassium dichromate for 60 seconds at 95°–100° C. If desired, passivation can be accomplished with solutions containing other chromate +6 ions, or by exposing the mandrel surface to conventional nickel-electroplating baths without applying a voltage.

Following passivation, the mandrel preferably is rinsed with distilled water and promptly contacted again with wetting-agent solution (see above). While wet, the mandrel is immersed in a suitable electroplating solution and provided with an adherent, substantially crack-free tubular nickel coating having sufficient thickness (e.g., 10 mils) to be self-supporting. Any suitable stress-free nickel-plating bath may be used. Preferably, the bath is a standard stress-free nickel sulfamate plating bath which is virtually free of chloride. A suitable sulfamate plating bath is disclosed in the following reference: *Metal Finishing Guidebook and Directory,* Metal and Plastics Publications, Inc. (pp. 286–288). Preferably, the electroplating operation is initiated as soon as the mandrel contacts the plating solution; this can be accomplished by connecting the mandrel to the cathode before inserting the mandrel in the solution.

For best results, no dry spots should be allowed to form on the mandrel in the period between application of the wetting agent and electrodeposition of the nickel.

When the electrodeposited nickel has attained the desired thickness, the mandrel is removed from the bath. The replica, (the layer of electroplated nickel) then is promptly removed from the mandrel. If necessary, removal may be facilitated by cooling the mandrel relative to the replica and then sliding the replica off the mandrel. The smoothness of the inside surface of the replica is identical to that of the diamond-machined surface of the mandrel. The above-described method has been used to produce nickel replicas having mirror finishes whose surface variations are within ±0.2 microinch R.M.S. Preferably, the replica is stored and used in a low-humidity, constant-temperature environment.

After removal of the replica, the mandrel is rinsed with water and re-passivated as described above. It is then ready for the production of another replica by the electrodeposition operation cited. To obtain highest-quality replicas, the passivated mandrel should not be touched with bare hands.

Electrolessly plated nickel is an especially suitable material for the re-usable master (mandrel) surface because it is harder and more resistant to corrosion than electroplated nickel. Passivation with chromate +6 ions is especially advantageous because it does not adversely affect the optical quality of the as-machined electroless-nickel surface.

The foregoing description of the invention has been presented to explain the principles of the invention and enable those skilled in the art to utilize the invention in various forms and with various modifications suited to the intended use. It will be apparent that the invention is not limited to the formation of replicas by any particular configuration; for instance, the master (mandrel) and its replica may be planar.

It is intended that the scope of the invention be defined by the accompanying claims.

What is claimed is:

1. A method for producing mirror surfaces, comprising:

(a) electrolessly depositing nickel on an article to form an amorphous nickel surface thereon, (b) diamond-machining said surface to increase its smoothness and optical reflectivity, (c) passivating the machined nickel surface to render it incapable of bonding to electroplated nickel, (d) electrodepositing nickel on the passivated surface to form thereon a layer of electroplated nickel whose inner surface is a replica of said passivated surface, and (e) separating said electrodeposited layer intact from said passivated surface.

2. The method of claim 1 further characterized by the additional steps of:

(f) re-passivating the mandrel in accordance with step (c), and (g) repeating steps (d) and (e).

3. The method of claim 1 wherein step (c) comprises contacting the machined nickel surface with an aqueous solution containing chromate +6 ions.

4. The method of claim 1 wherein said electrodepositing operation is conducted in an aqueous nickel sulfamate plating bath.

5. The method of claim 4 wherein said bath is essentially free of chlorides.

6. The method of claim 4 further characterized by the step of contacting the passivated nickel surface obtained in step (c) with a wetting agent promoting the electrodeposition of nickel in step (d).

7. The method of claim 6 wherein said wetting agent is sodium lauryl sulfate.

8. A method of producing mirror surfaces, comprising:

(a) electrolessly depositing nickel on an article to form an amorphous nickel surface thereon, (b) diamond-machining said surface to increase its smoothness and optical reflectivity, (c) passivating the machined nickel surface to render it incapable of bonding to electroplated nickel, (d) contacting the passivated nickel surface with a wetting agent, (e) electrodepositing nickel on the passivated surface in an aqueous nickel sulfamate plating bath substantially free of chlorides to form thereon a layer of electroplated nickel whose inner surface is a replica of said passivated surface, and (f) separating said electroplated layer intact from said passivated surface.

9. The method of claim 8 wherein step (c) comprises contacting the machined nickel surface with an aqueous solution containing chromate ions.

10. The method of claim 8 wherein said wetting agent is sodium lauryl sulfate.

* * * * *